US010082068B2

(12) United States Patent
Byun

(10) Patent No.: US 10,082,068 B2
(45) Date of Patent: Sep. 25, 2018

(54) RADIATOR HAVING AIR GUIDE FOR PREVENTING HEAT DAMAGE IN A VEHICLE

(71) Applicant: HYUNDAI MOTOR COMPANY, Seoul (KR)

(72) Inventor: Hyung-Suk Byun, Hwaseong-si (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 483 days.

(21) Appl. No.: 14/880,137

(22) Filed: Oct. 9, 2015

(65) Prior Publication Data

US 2016/0144687 A1 May 26, 2016

(30) Foreign Application Priority Data

Nov. 25, 2014 (KR) ..... 10-2014-0165156

(51) Int. Cl.

| | |
|---|---|
| ***B60H 1/00*** | (2006.01) |
| ***F01P 1/06*** | (2006.01) |
| ***F01P 11/10*** | (2006.01) |

(52) U.S. Cl.

CPC ..... *F01P 1/06* (2013.01); *F01P 11/10* (2013.01)

(58) Field of Classification Search

CPC ..... F01P 1/06; F01P 11/10
USPC ..... 165/41
See application file for complete search history.

(56) References Cited

U.S. PATENT DOCUMENTS

| | | | | | |
|---|---|---|---|---|---|
| 1,427,687 | A * | 8/1922 | Johnson | F01P 7/081 | 123/41.49 |
| 1,489,841 | A * | 4/1924 | MacDonald | F01P 7/06 | 123/41.49 |
| 2,132,450 | A * | 10/1938 | Wolf | B60K 5/08 | 105/34.1 |
| 2,155,287 | A * | 4/1939 | Wolf | B60K 5/04 | 180/292 |
| 2,211,971 | A * | 8/1940 | Flanders | F01M 1/22 | 123/196 S |
| 2,454,182 | A * | 11/1948 | Kampa | F01P 7/085 | 123/41.12 |
| 2,527,487 | A * | 10/1950 | Paton | B60K 11/08 | 180/292 |
| 3,058,724 | A * | 10/1962 | Maudlin | F25B 13/00 | 165/233 |

(Continued)

FOREIGN PATENT DOCUMENTS

| | | |
|---|---|---|
| JP | 57-137616 A | 8/1982 |
| JP | 62-068127 A | 3/1987 |

(Continued)

*Primary Examiner* — Ljiljana Ciric
(74) *Attorney, Agent, or Firm* — McDermott Will & Emery LLP

(57) ABSTRACT

A radiator for cooling a heated coolant includes an air guide for preventing heat damage. The air guide is adapted to allow air entering into the radiator due to the operation of a cooling fan to flow into a gear box of a fan clutch, wherein the cooling fan is installed at an inside of the vehicle and is activated by the fan clutch. The air guide can be installed above the cooling fan and thus allow air entering due to the operation of the cooling fan to flow horizontally, and further allow the air to flow vertically and downwardly such that the air is ejected downwardly towards a region where the gear box is installed.

11 Claims, 6 Drawing Sheets

(56) References Cited

U.S. PATENT DOCUMENTS 4,393,966 A * 7/1983 Kono ..... F04B 49/065 192/103 R
4,604,974 A 8/1986 Watanabe
4,692,053 A * 9/1987 Sampedro ..... F01P 5/04 123/41.49
5,184,472 A * 2/1993 Guilbault ..... F24J 2/423 62/160
5,188,136 A * 2/1993 Kumagai ..... B08B 15/002 134/133
5,205,484 A 4/1993 Susa et al.
5,765,672 A * 6/1998 Briggs ..... F01P 11/14 123/41.11
5,832,735 A * 11/1998 Matsumoto ..... F25B 13/00 62/151
5,938,405 A * 8/1999 Coleman ..... F01P 5/04 416/169 A
5,984,070 A * 11/1999 Briggs ..... F01P 7/085 123/41.11
6,106,228 A * 8/2000 Bartlett ..... F01P 11/10 123/41.11
6,113,351 A * 9/2000 McCallum ..... F04D 29/063 123/41.49
6,527,516 B2 * 3/2003 Crevel ..... F04D 29/263 403/282
6,644,922 B2 * 11/2003 McCallum ..... F04D 29/063 416/156
6,659,724 B2 * 12/2003 Takeuchi ..... F04D 29/325 123/41.49
6,786,291 B1 * 9/2004 Linden ..... B62D 21/02 123/41.56
6,790,006 B2 * 9/2004 Robb ..... F04D 29/325 416/135
6,908,284 B2 * 6/2005 Adrian ..... F04D 29/263 416/134 R
7,063,125 B2 * 6/2006 Tembreull ..... F01P 5/06 165/121
8,360,219 B2 * 1/2013 Swanson ..... F16D 25/0632 192/114 R
8,408,169 B2 * 4/2013 Dybdal ..... F01P 5/04 123/41.11
8,408,170 B2 * 4/2013 Kardos ..... F01P 7/026 123/41.12
9,482,144 B2 * 11/2016 Hutchison ..... F16D 25/0632
9,523,372 B2 * 12/2016 Stagg ..... B29C 45/14336
9,765,684 B2 * 9/2017 Schroeder ..... F01P 7/06
2005/0050985 A1 * 3/2005 Crissy ..... F16F 15/126 74/574.4
2011/0138829 A1 * 6/2011 Koh ..... F25B 25/00 62/160
2012/0297812 A1 * 11/2012 Takata ..... F24F 1/68 62/324.6
2012/0304675 A1 * 12/2012 Motomura ..... F24F 3/06 62/156
2013/0312436 A1 * 11/2013 Chen ..... F25B 47/025 62/81
2014/0026601 A1 * 1/2014 Chen ..... F25B 47/025 62/81
2014/0169991 A1 * 6/2014 Byun ..... F01P 7/044 417/201
2014/0182320 A1 * 7/2014 Hatomura ..... F25B 13/00 62/278
2014/0223940 A1 * 8/2014 Morimoto ..... F25B 49/027 62/183
2015/0247661 A1 * 9/2015 Ishimura ..... F25B 13/00 62/225
2015/0300714 A1 * 10/2015 Ishimura ..... F25B 13/00 62/225

FOREIGN PATENT DOCUMENTS

JP 09-112662 A 5/1997
JP 10-252462 A 9/1998
JP 2002-029269 A 1/2002
JP 2010-132194 A 6/2010
KR 10-2003-0026041 3/2003
KR 10-0521536 B1 10/2005
KR 10-2005-0108764 A 11/2005
KR 10-0827644 B1 5/2008

* cited by examiner

RADIATOR HAVING AIR GUIDE FOR PREVENTING HEAT DAMAGE IN A VEHICLE

CROSS-REFERENCE TO RELATED APPLICATIONS

This application claims priority to Korean Patent Application No. 10-2014-0165156, filed on Nov. 25, 2014 with the Korean Intellectual Property Office, which is incorporated herein by reference in its entirety.

TECHNICAL FIELD

The present disclosure relates to a radiator dissipating heat from a coolant resulting from cooling an engine and, particularly, to a radiator having an air guide for preventing heat damage by means of controlling air to prevent hot air from flowing into a fan clutch part which drives a cooling fan due to a negative pressure generated by the cooling fan of the radiator.

BACKGROUND

In a large-sized vehicle, such as a bus, due to an increased heat dissipation rate from exhaust gas regulation strengthening and power enhancement, as shown FIGS. 1 and 2, a radiator for cooling an engine is installed at a lateral side of a vehicle along a longitudinal orientation.

The vehicle includes a cooling fan 13 for drawing in ambient air and transferring it into the radiator 12. The cooling fan 13 is activated by a fan clutch, and a driving power generated from the engine 11 is transferred through a crank pulley 14 to a gear box 15 of the fan clutch.

However, according to the conventional technology described above, a negative pressure is generated around the cooling fan 13 due to the operation of the cooling fan 13 and hot air flows into the region where the gear box 15 is installed. Therefore, this raises the temperature in the region on which the fan clutch is installed.

When the cooling fan is operated, a greater amount of cool air coming from the outside is radiated toward the circumference of the cooling fan 13. However, because of a negative pressure of a central portion at the time of rotation of the cooling fan 13, a portion of hot air flows into the gear box 15 of the fan clutch from hot parts such as an engine, EGR system or a turbocharger.

In this way, at the time of the operation of the cooling fan 13, hot air around the engine 11 flows toward the gearbox 15 of the fan clutch and consequently the temperature of the inside of the gearbox 15 of the fan clutch is increased. As a result, an oil seal within the gearbox of the fan clutch may become damaged and the oil may become degraded.

SUMMARY OF THE DISCLOSURE

The present disclosure has an object of solving the problem described above. Specifically, an object of the present disclosure is to provide a radiator having an air guide for blocking hot air generated from the engine, or the peripheral region thereof, from flowing toward the central portion of a cooling fan by controlling the flow of air entering from the outside according to rotation of the cooling fan when the cooling fan is rotated to cool the radiator of a bus, so as to prevent heat damage.

According to an embodiment of the present disclosure, provided is a radiator having an air guide for preventing heat damage, the radiator dissipating the heat of a hot coolant resulting from a cooling of an engine of a vehicle and having an air guide for preventing heat damage. The air guide is adapted to allow air entering into the radiator due to the operation of a cooling fan to flow into a gear box of a fan clutch to prevent heat damage, wherein the cooling fan is installed at the inside of the vehicle and the fan clutch activates the cooling fan.

The air guide is installed above the cooling fan. Thus, the air guide allows air entering due to the operation of the cooling fan to flow horizontally and then vertically and downwardly such that the air is ejected downwardly towards a region in which the gear box is installed.

The air guide has a first region to which air enters from the outside and a second region from which the air is ejected into the gear box. The first region is formed over a predefined length horizontally and the second region is formed vertically.

The air guide is open at the region directed towards the cooling fan.

The air guide has an internal partition and the internal partition is formed along a flow direction of air entering from the outside.

A regulating plate is installed in the internal partition in a region from which is ejected into the gear box. The regulating plate is designed to control a direction of air ejected from the air guide.

A cover is installed in the gear box in a region which is directed towards an engine and the cover is adapted to block air ejected from the engine from flowing into the gear box.

An ejection direction of air is set in the air guide in a region from which the air is ejected such that the air ejected from the air guide may enter between the cover and the gear box.

The cover may be arranged upwardly and downwardly.

The air guide is fixed to the radiator and is installed on a cooling fan frame, on which the fan clutch and the cooling fan are installed.

The vehicle may be a bus.

A radiator having an air guide for preventing heat damage, in accordance with the present disclosure, may prevent hot air generated from the engine and the surroundings thereof from flowing into the center of the cooling fan and thus degrading oil with which the gear box of the fan clutch is filled and causing an oil seal to burn-out and wherein the fan clutch rotates the cooling fan, by controlling air entering from the outside by the air guide such that the air may flow towards the center of the cooling fan.

DETAILED DESCRIPTION

Figure 1:
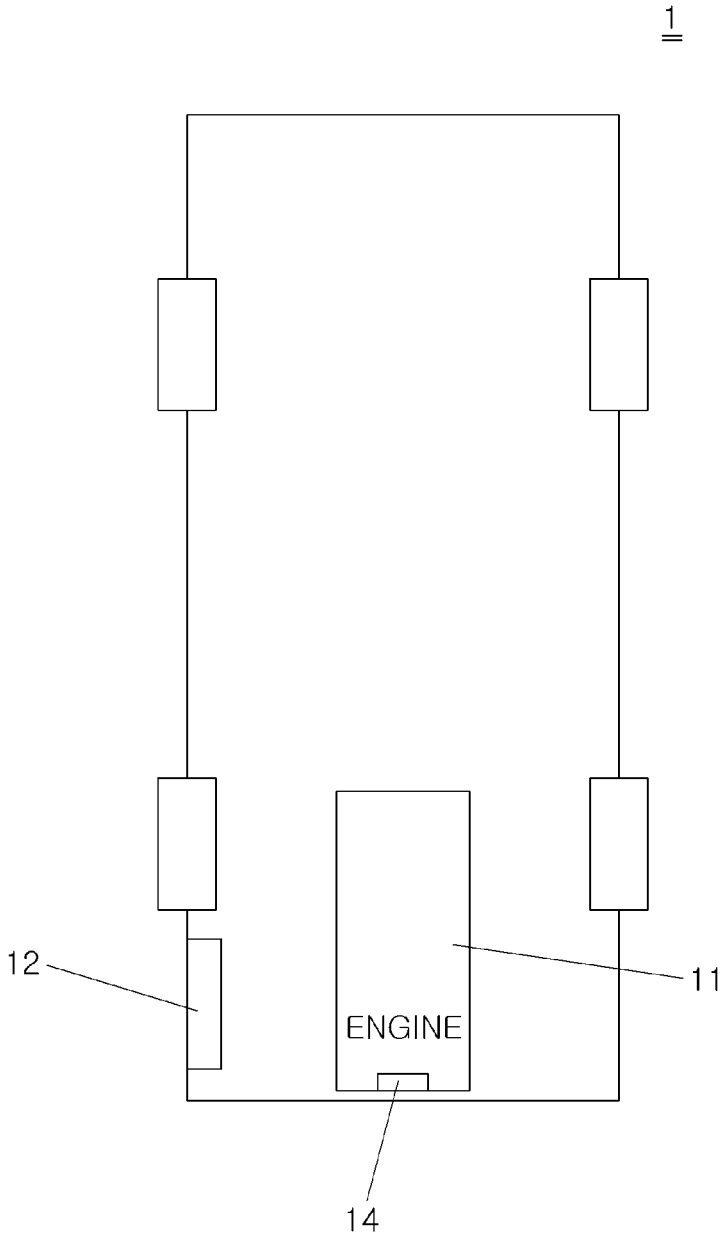
FIG. 1 is a schematic view illustrating an arrangement of an engine and a radiator in a bus according to the prior art.

Exemplary embodiments of a radiator having an air guide for preventing heat damage in accordance with the present disclosure will be described below in further detail with reference to the accompanying drawings.

A radiator having an air guide for preventing heat damage according to one embodiment includes an air guide 21 for allowing air entering into the radiator 12 due to the operation of a cooling fan 13 mounted within a vehicle to flow into a gearbox 15 of a fan clutch for driving the cooling fan 13.

In a bus, or other type of vehicle, a radiator 12 may be mounted at a lateral side of the bus wherein the radiator 12 dissipates the heat of a hot coolant coming from the engine 11 and then circulates the coolant back to the engine 11.

A cooling fan 13 adapted to allow the ambient air to flow from the outside to the radiator 12 is installed adjacent the radiator 12. The cooling fan 13 is mechanically connected to the engine 11 or is driven by a separate power source.

Figure 2:
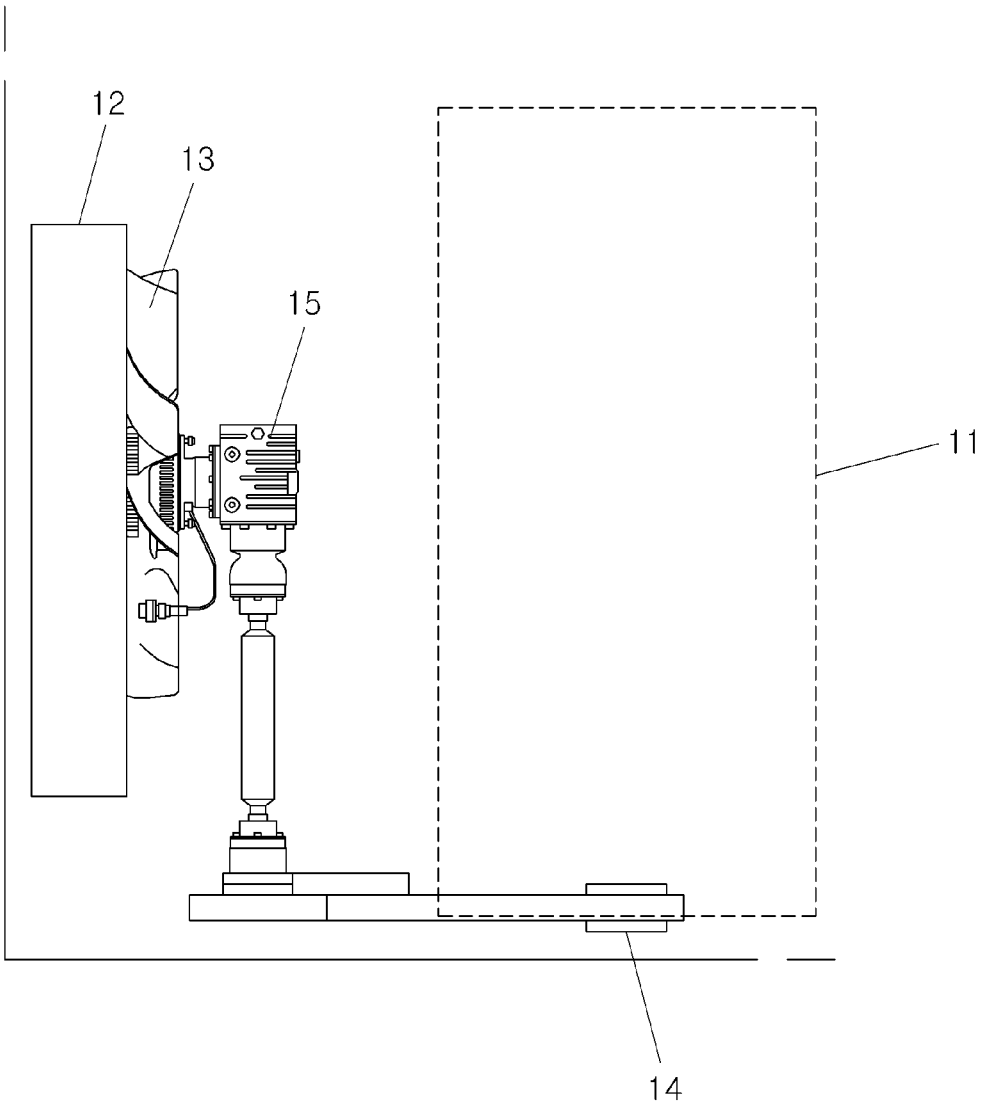
FIG. 2 is a schematic view illustrating a power transmission configuration between an engine and a radiator in the bus according to the prior art.
Figure 3:
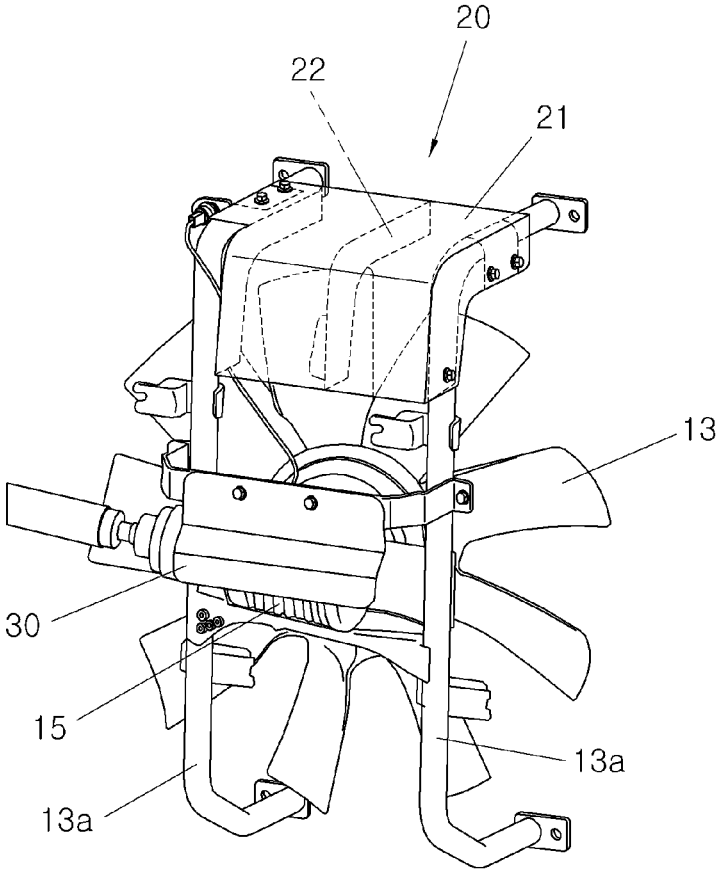
FIG. 3 is a perspective view of a radiator having an air guide for preventing heat damage according to one embodiment of the present disclosure.
Figure 4:
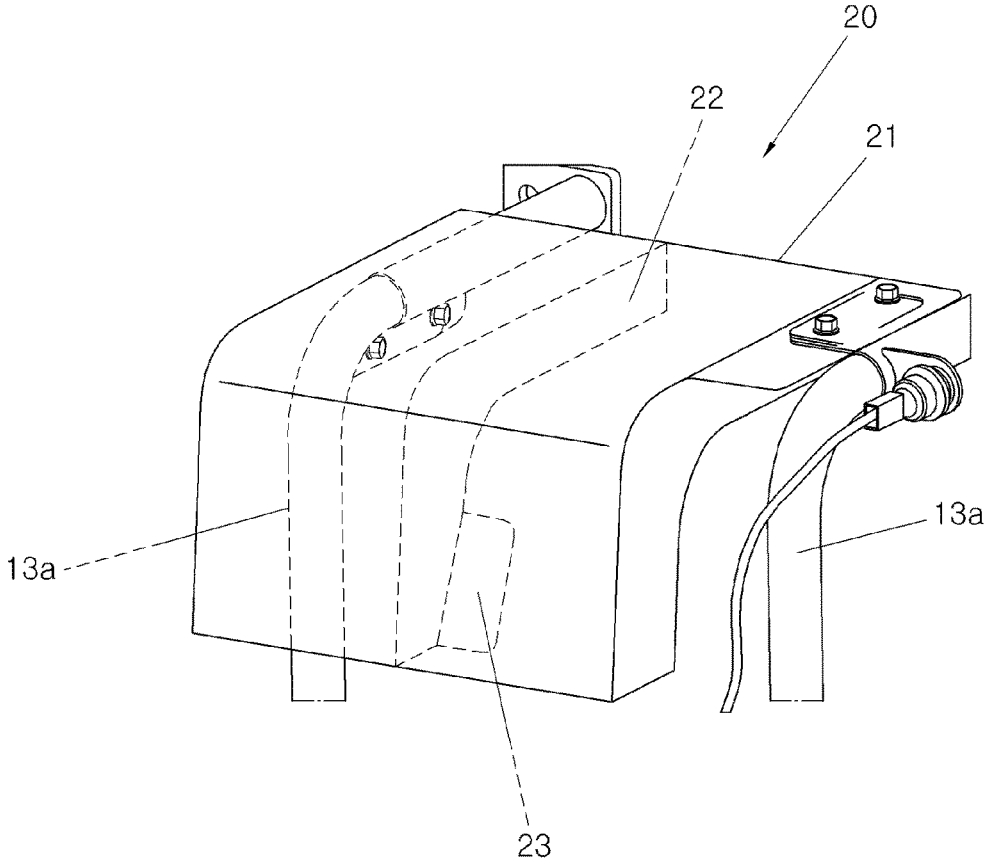
FIG. 4 is a perspective view of a radiator having an air guide for preventing heat damage according to one embodiment of the present disclosure.
Figure 5:
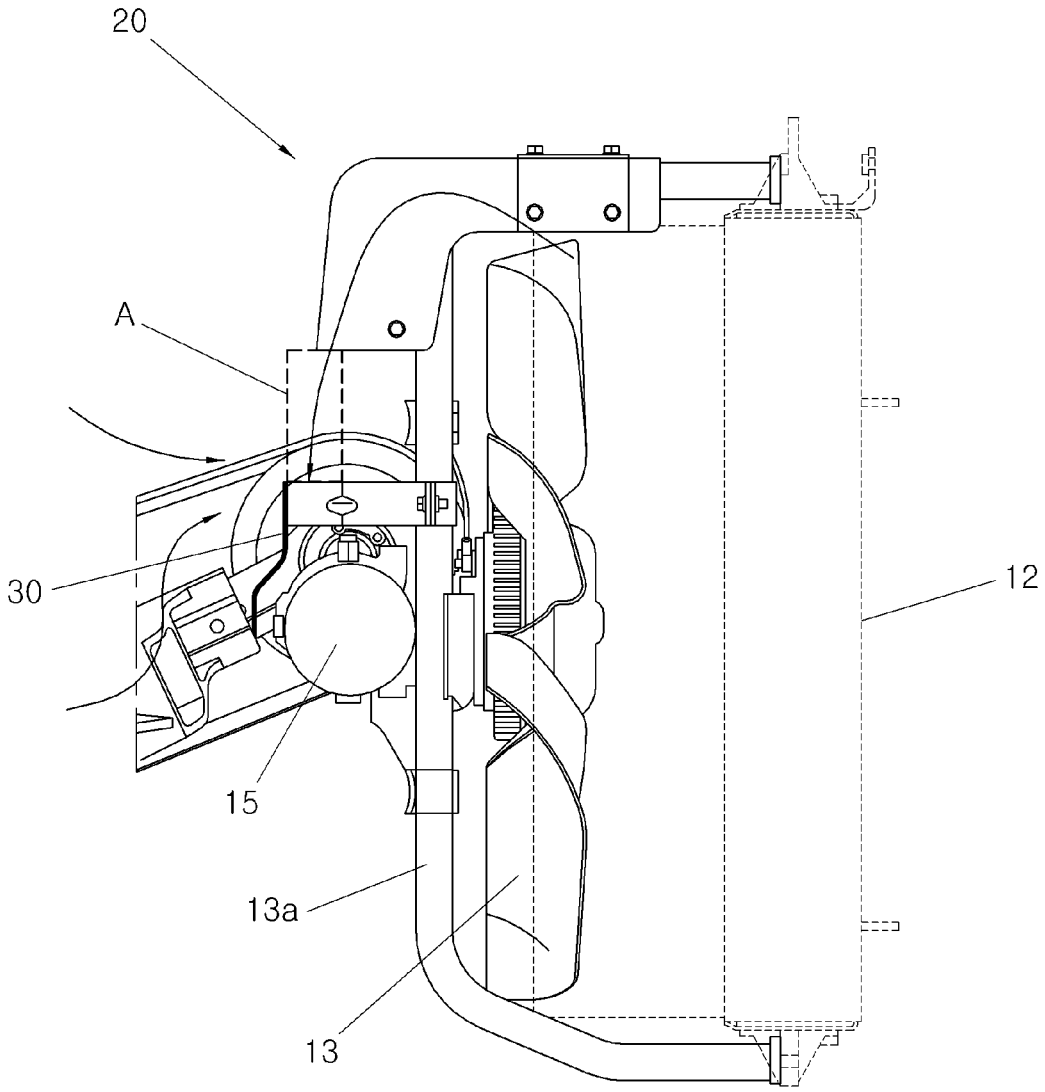
FIG. 5 is a side view illustrating an air flow in the surroundings of a radiator having an air guide for preventing heat damage according to one embodiment of the present disclosure.
Figure 6:
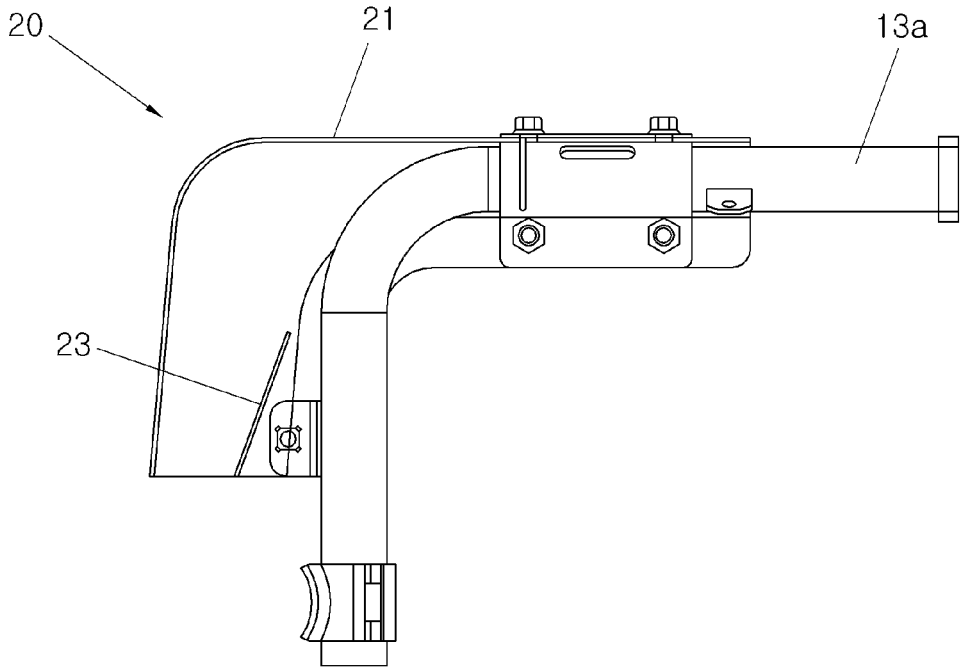
FIG. 6 is a side view of a radiator having an air guide for preventing heat damage according to one embodiment of the present disclosure.

For example, as already described in FIGS. 1 and 2, a portion of the driving force from the engine 11 is transferred from a crank pulley 14 of the engine 11 through a power transmission means such as a belt and a gear to a gear box 15 of the fan clutch for activating the cooling fan 13.

If the portion of the driving force from the engine 11 is transferred into the gear box 15, the cooling fan 13 is activated, thereby allowing the ambient air to flow into the radiator 12. As the result, cooling of the coolant passing through the inside of the radiator 12 is capable of being promoted.

When the cooling fan 13 is activated, the pressure at the region where the gear box 15 is installed is relatively lowered and thereby air from the surrounding EGR system 16, turbocharger 17, and engine 11 flows into the gear box 15, consequently inducing heat damage. Therefore, by controlling the flow of air flowing from the outside, the hot air may be prevented from flowing into the gear box 15.

As a specific means for this prevention, the air guide 21, as shown in FIGS. 3 to 6, is installed at the region adjacent to the radiator 12 or the cooling fan 13, thereby blocking hot air from flowing toward the radiator 15. Consequently, heat damage may be prevented.

The air guide 21 will be described below in more detail.

The air guide 21 is installed above the radiator 12 or the cooling fan 13 such that air entering from the outside and then passing above the radiator 12 or the cooling fan 13 is ejected into the gear box 15 which is positioned at the center of the cooling fan 13.

The air guide 21 is formed horizontally over a predefined length, to allow air coming from the outside to flow, and is formed vertically over the remaining length to allow the air to be discharged into the gear box 15. Both lateral faces of air flow direction are formed to be bent downwardly such that the air flowing from the outside is not dispersed.

A portion of the air guide 21 directed downwardly, i.e., towards the cooling fan 13, is open.

Further, the air guide 21 has an internal partition 22 at its bottom surface along the direction of air-flow. The internal partition 22 is designed to control the air passing by the interior of the air guide 21 due to the rotation of the cooling fan 13 such that this air may flow without dispersion along the direction in which the air guide 21 is installed.

Furthermore, a regulating plate 23 is formed in the internal partition 22 at a portion from which air is ejected. Thus the regulating plate 23 is designed to control the direction of air ejected from the air guide 21. An air curtain which blocks the inflow of hot air ejected from the engine 11 is formed by air ejected from the air guide 21 and the direction of the air curtain is regulated by the regulating plate 23.

An upper end and a lower end of the air guide 21 are combined with the radiator 12. The air guide 21 may be installed on a cooling fan frame 13*a* to be positioned above the cooling fan 13 wherein the radiator 12 and the gear box 15 are installed at the intermediate portion of the cooling fan frame 13*a*.

Meanwhile, a cover 30 is installed in the gear box 15 in a region directed towards an engine 11 such that air is ejected from the air guide 21 and will flow into the gear box 15 and may pass through the gear box 15 without being mixed with air ejected from the engine 11.

The cover 30 is a substantially upwardly and downwardly extending plate. The cover 30 is designed to block hot air around the engine 11 from flowing into the gear box 15 as the air ejected from the air guide 21 flows between the cover 30 and the gear box 15. It is preferable that an ejection direction of air is set in the air guide 21 such that the air ejected from the air guide 21 may enter between the cover 30 and the gear box 15.

The operation of a radiator having an air guide for preventing heat damage with the configuration described above according to one embodiment of the present disclosure will be described below.

As the engine is operated, a coolant which has cooled the engine 11 circulates between the engine 11 and the radiator 12, and the heat of the coolant is dissipated at the radiator 12. The cooling fan 13 is operated to enhance heat dissipation performance of the radiator 12.

If the cooling fan 13 is operated, the ambient air enters from the outside and travels to the radiator 12 and a portion thereof is entered into the air guide 21.

After the air enters into the air guide 21 passes through the inside of the air guide 21, the air is ejected from the air guide 21 to the gear box 15. As air is ejected continuously from the air guide 21 to the gear box 15, a so-called "air curtain" is formed. The air curtain may block hot air around the engine 11 from flowing into the gear box 15.

In particular, the cover 30 is installed above the gear box 15 and air ejected from the air guide 21 enters between the cover 30 and the gear box 15. Therefore, a path of the hot air into the gear box 15 may be blocked.

At the region of the engine, the flow rate is low but the hot air is present. Meanwhile, a large amount of air whose flow direction is changed by the air guide 21 is ejected into the gear box 15, thereby preventing that hot air at the side of the engine 11 from entering into the gear box 15.

While the present disclosure has been described with respect to the specific embodiments, it will be apparent to those skilled in the art that various changes and modifications may be made without departing from the spirit and scope of the disclosure as defined in the following claims.

What is claimed is:

1. A radiator system for cooling a coolant heated by an engine of a vehicle, comprising:

a cooling fan; and, a radiator having an air guide for preventing heat damage, the air guide being adapted to allow air entering into the radiator due to the operation of the cooling fan to flow into a gear box of a fan clutch, wherein the cooling fan is installed at an interior of the vehicle and is activated by the fan clutch.

2. The radiator system of claim 1, wherein the air guide is installed above the cooling fan and thus allows air entering due to the operation of the cooling fan to flow horizontally, and further allows the air to flow vertically and downwardly such that the air is ejected downwardly towards a region where the gear box is installed.

3. The radiator system of claim 1, wherein the air guide has a first region into which air enters from the outside and a second region from which the air is ejected into the gear box, the first region being formed over a predefined length horizontally and the second region being formed vertically.

4. The radiator system of claim 1, wherein the air guide is open at a region which is directed towards the cooling fan.

5. The radiator system of claim 1, wherein the air guide has an internal partition at an inside of the air guide, the internal partition being formed along a flow direction of air which enters from the outside.

6. The radiator system of claim 5, wherein a regulating plate is installed in the internal partition in a region from which air is ejected into the gear box, the regulating plate controlling a direction of air which is ejected from the air guide.

7. The radiator system of claim 1, wherein a cover is installed in the gear box in a region which is directed towards an engine, the cover being adapted to block air ejected from the engine from flowing into the gear box.

8. The radiator system of claim 7, wherein an ejection direction of air is set in the air guide in a region from which the air is ejected such that the air ejected from the air guide may enter between the cover and the gear box.

9. The radiator system of claim 7, wherein the cover is arranged both upwardly and downwardly.

10. The radiator system of claim 1, wherein the air guide is fixed to the radiator and is installed on a cooling fan frame, and where the fan clutch and the cooling fan are installed on the cooling fan frame.

11. The radiator system of claim 1, wherein the vehicle is a bus.

* * * * *